United States Patent [19]

Matsuoka et al.

[11] Patent Number: 4,870,048

[45] Date of Patent: Sep. 26, 1989

[54] COLOR DEVELOPER SHEET

[75] Inventors: Katsumi Matsuoka; Shojiro Sano; Keiso Saeki; Masanobu Takashima; Ken Iwakura, all of Shizuoka, Japan

[73] Assignee: Fuji Photo Film Co., Ltd., Kanagawa, Japan

[21] Appl. No.: 179,356

[22] Filed: Apr. 8, 1988

[30] Foreign Application Priority Data

Apr. 8, 1987 [JP] Japan ..... 62-86094

[51] Int. Cl.[4] ..... B41M 5/16

[52] U.S. Cl. ..... 503/211; 427/150; 427/151; 428/342; 428/914; 503/212; 503/216; 503/225

[58] Field of Search ..... 428/341, 342, 913, 914; 503/210–212, 216, 225

[56] References Cited

U.S. PATENT DOCUMENTS

| | | | |
|---|---|---|---|
| 4,260,179 | 9/1981 | Yamaguchi et al. | 503/212 |
| 4,262,938 | 4/1981 | Yamaguchi et al. | 503/211 |
| 4,407,892 | 10/1983 | Yamaguchi et al. | 503/210 |

FOREIGN PATENT DOCUMENTS

| | | | |
|---|---|---|---|
| 2060017 | 4/1981 | United Kingdom | 503/212 |

*Primary Examiner*—Bruce H. Hess

*Attorney, Agent, or Firm*—Sughrue, Mion, Zinn, Macpeak & Seas

[57] ABSTRACT

A color developer sheet which brings about color development by contact with a substantially colorless electron-donating color former, where said sheet contains an organometallic compound represented by the following general formula (I), (II) or (III) to enhance light resistance and stability of the color product obtained by the color development:

(I)

(II)

(III)

wherein M represents a nickel atom, a copper atom, a cobalt atom, or a zinc atom; $X_1$ and $X_2$ each represents an oxygen atom, a sulfur atom, or —$NR_5$—, in which $R_5$ represents a hydrogen atom, an alkyl group, an aryl group, or a hydroxyl group; $X_3$ represents a hydroxyl group, or a mercapto group; Y represents an oxygen atom, a sulfur atom, or —$CHR_6$, in which $R_6$ represents a hydrogen atom, an alkyl group, or an aryl group; $R_1$, $R_2$, $R_3$ and $R_4$ each represents a hydrogen atom, a halogen atom, a cyano group, or an alkyl, aryl, cycloalkyl or heterocyclyl group attached to the carbon atom directly or via a divalent linkage group, or at least either combination of $R_1$ and $R_2$ and/or $R_3$ and $R_4$ may be connected to each other to form a 5- or 6-membered ring together with the carbon atoms; and Z represents an organic ligand which forms a complex by binding to M via its hetero atom.

14 Claims, No Drawings

COLOR DEVELOPER SHEET

FIELD OF THE INVENTION

The present invention relates to a color developer sheet which can cause color development by contact with a substantially colorless electron-donating color former. In particualr, it is concerned with improvement in light resistance of the color produced by the above-described color-development reaction.

BACKGROUND OF THE INVENTION

Pressures sensitive recording materials of the kind which utilize the coloration reaction of a color former (which can form a color by donating an electron or by accepting a proton from an acid or the like) with a color developer (which is a substance capable of accepting an electron or donating a proton, e.g., clay substances such as acid clay, activated caly, attapulgite, zeolite, bentonite and kaoline, organic acids such as salicylic acid, tannic acid, gallic acid and phenolic compounds, metal salts of these acids, and acidic polymers like phenol-formaldehyde resin) have so far been well-known. Such recording materials are described, e.g., in U.S. Pat. Nos. 2,505,470, 2,505,489, 2,550,471, 2,548,366, 2,712,507, 2,730,456, 2,730,457 and 3,418,250, Japanese Patent Application (OPI) Nos. 28411/74 (corresponding to U.S. Pat. No. 3,896,255) and 44009/75 (the term "OPI" as used herein means an "published unexamined Japanese patent application"), and so on.

A color former layer of pressure sensitive copying paper is obtained by dissolving a color former in a solvent, dispersing the resulting solution into a binder or enmicrocapsulating the solution, and then coating it on a support such as paper, plastic films, resin-coated paper and the like.

On the other hand, a color developer sheet is obtained by dissolving or dispersing a color developer together with a binder in a medium, such as water or the like, and coating it on a support.

In general, a color former and a color developer are coated on the same side of a support, on the front and the back sides of a support respectively, or on separate supports.

When pressure is applied to copying paper with a pen or a typewriter, a color former enclosed in microcapsules is released in the pressure-applied positions. The released color former then comes into contact with a color developer. Thereupon, color development takes place, and a record corresponding to applied pressures is obtained.

As described above, various kinds of substances are known as a color developer usable in a pressure sensitive recording material.

However, colors produced by using clays, such as activated clay, acid clay, etc., which have been prevailingly employed as a color developer up to the present, suffer from such defects as poor light or water resistance, poor stability with the elapse of time, and so on.

As for the color developers free from the above-described defects, organic color developers are known.

In general, a color developer sheet is produced as follows. A coating composition (A) is prepared by mechanically dispersing an organic color developer into water together with an inorganic pigment, a binder, a dispersant and other additives. Alternatively, a coating composition (B) is prepared by dissolving an organic color developer in an organic solvent, emulsifying the solution in water and adding an inorganic pigment, a binder and other additives to the emulsion. Next, (A), (B) or a mixture of (A) and (B) is coated on a support to produce a actual color developer sheet.

Although the color developer sheets obtained in these manners have various excellent properties, they still exhibit insufficinet fastness to light.

SUMMARY OF THE INVENTION

An object of the present invention is to provide a color developer sheet which can develop colors excellent in both light resistance and stability with the elapse of time.

The object of the present invention is attained with a color developer sheet which brings about color development by contact with a substantially colorless electron-donating color former, where the sheet contains an organometallic compound represented by the following general formula (I), (II) or (III):

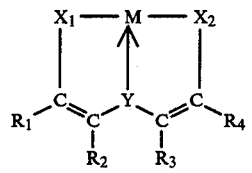

(I)

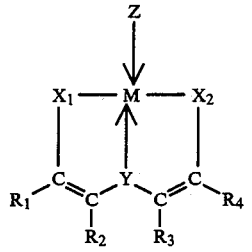

(II)

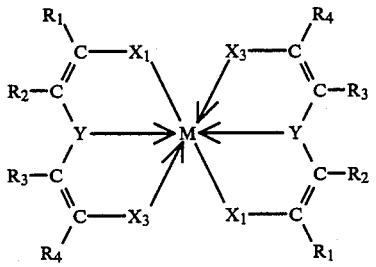

(III)

wherein M represents a nickel atom, a copper atom, a cobalt atom, or a zinc atom; $X_1$ and $X_2$ each represents an oxygen atom, a sulfur atom, or —$NR_5$—, in which $R_5$ represents a hydrogen atom, an alkyl group, an aryl group, or a hydroxyl group; $X_3$ represents a hydroxyl group, or a mercapto group; Y represents an oxygen atom, a sulfur atom, or —$CHR_6$, in which $R_6$ represents a hydrogen atom, an alkyl group, or an aryl group; $R_1$, $R_2$, $R_3$ and $R_4$ each represents a hydrogen atom, a halogen atom, a cyano group, or an alkyl, aryl, cycloalkyl or heterocyclyl group attached to the carbon atom directly or via a divalent linkage group, or at least either combination of $R_1$ and $R_2$ and/or $R_3$ and $R_4$ may be connected to each other to form a 5- or 6-membered ring together with the carbon atoms; and Z represents an organic ligand which forms a complex by binding to M via its hetero atom.

DETAILED DESCRIPTION OF THE INVENTION

Metal complexes represented by the foregoing general formulae (I), (II) and (III), respectively, may be used alone or as a mixture of two or more thereof. In all cases, the object of the present invention can be fully achieved.

$X_1$ and $X_2$ in both general formulae (I) and (II) may be the same as or different from another. $X_1$ and $X_2$ in the general formulae (I), (II) and (III) each represents an oxygen atom, a sulfur atom, or —$NR_5$, wherein $R_5$ represents a hydrogen atom, an alkyl group (e.g., methyl, ethyl, n-propyl, i-propyl, n-butyl, t-butyl, i-butyl, pentyl, etc.), an aryl group (e.g., phenyl, tolyl, napthyl, etc.), or a hydroxyl group. Of these groups, oxygen and sulfur atoms are preferred, and an oxygen atom is more preferred than a sulfur atom.

$X_3$ in the general formula (III) represents a hydroxyl group or a mercapto group, preferably a hydroxyl group.

Y in the general formulae (I), (II) and (III) represents an oxygen atom, a sulfur atom, or —$CHR_6$, wherein $R_6$ represents a hydrogen atom, an alkyl group (e.g., methyl, ethyl, n-propyl, i-propyl, n-butyl, t-butyl, i-butyl, benzyl, etc.), or an aryl group (e.g., phenyl, tolyl, naphthyl etc.). Of these groups, a sulfur atom or —$CHR_6$ are preferred, and a sulfur atom is most preferred. The two Y's present in the general formula (III) may be the same as or different from each other.

$R_1$, $R_2$, $R_3$ and $R_4$ in the general formulae (I) to (III), which may be the same or different, each represents a hydrogen atom, a halogen atom (including fluorine, chlorine, bromine and iodine), a cyano group, or a straight or branched chain alkyl (e.g., methyl, ethyl, propyl, butyl, hexyl, octyl, dodecyl, hexadecyl, etc.), aryl (e.g., phenyl, naphthyl, etc.), cycloalkyl (e.g., cyclopentyl, cyclohexyl, etc.) or heterocyclyl (e.g., pyridyl, imidazolyl, furyl, thienyl, pyrrolyl, pyrrolidyl, quinolyl, morpholinyl, etc.) group attached to the carbon atom directly or via a divalent linkage group, e.g., —O—, —S—, —NH—, —$NR'_5$— [wherein $R'_5$ represents a monovalent group such as hydroxyl, alkyl (e.g., methyl, ethyl, n-propyl, i-propyl, n-butyl, t-butyl, i-butyl, etc.), aryl (e.g., phenyl, tolyl, naphthyl, etc.), or so on], —OCO—, —CO—, —NHCO—, —CONH—, —COO—, —$SO_2$NH—, —NH$SO_2$—, —$SO_2$—, etc.. As specific examples of a group formed by combining an alkyl, aryl, cycloalkyl or heterocyclyl group (which is to be attached to the carbon atom via a divalent linkage group) with the divalent linkage group, mention may be made of an alkoxy group (including straight chain and branched chain alkyloxy groups, such as methoxy, ethoxy, n-butyloxy, octyloxy, etc.), an alkoxycarbonyl group (including straight chain and branched chain alkyloxycarbonyl groups, such as methoxycarbonyl, ethoxycarbonyl, n-hexadecyloxycarbonyl, etc.), an alkylcarbonyl group (including straight and branched chain alkylcarbonyl groups, such as acetyl, valeryl, stearoyl, etc.), an arylcarbonyl group (such as benzoyl, etc.), an alkylamino group (including straight and branched chain alkylamino groups, such as N-n-butylamino, N,N-di-n-butylamino, N,N-di-n-octylamino, etc.), an alkylcarbamoyl group (including straight and branched chain alkylcarbamoyl groups, such as n-butylcarbamoyl, n-dodecylcarbamoyl, etc.), an alkylsulfamoyl group (including straight and branched chain alkylsulfomoyl groups, such as n-butylsulfamoyl, n-dodecylsulfamoyl, etc.), an alkylacylamino group (including straight and branched chain alkylcarbonylamino groups, such as acetylamino, palmitoylamino, etc.), an aryloxy group (e.g., phenoxy, naphthoxy, etc.), an aryloxycarbonyl group (e.g., phenoxycarbonyl, naphthoxycarbonyl, etc.), an arylamino group (e.g., N-phenylamino, N-phenyl-N-methylamino, etc.), an arylcarbamoyl group (e.g., phenylcarbamoyl, etc.), an arylsulfamoyl group (e.g., phenylsulfamoyl group, etc.), an arylacrylamino group (e.g., benzoylamino, etc.), and so on.

In the general formulae (I), (II) and (III), at least either combination of $R_1$ and $R_2$ and/or $R_3$ and $R_4$ may form a 5- or 6-membered ring together with the carbon atoms to which they are attached respectively. Specific examples of such 5- or 6-membered rings include hydrocarbon rings containing at least one unsaturated bond, such as a cyclopentene ring, a cyclohexene ring, a benzene ring (including condensed benzene rings, e.g., a naphthaline ring and an anthracene ring), and heterocyclic rings (e.g., 5- or 6-membered nitrogen-containing hetero rings). As examples of substituent groups with which the above-cited hetero rings may be substituted, mention may be made of halogen atoms (including fluorine, chlorine, bromine and iodine), a cyano group, alkyl groups (including straight and branched chain alkyl groups containing 1 to 20 carbon atoms, e.g., methyl, ethyl, n-propyl, n-butyl, n-octyl, t-octyl, n-hexadecyl, etc.), aryl groups (e.g., phenyl, naphthyl, etc.), alkoxy groups (including straight and branched chain alkyloxy groups, e.g., methoxy, n-butoxy, t-butoxy, etc.), aryloxy groups (e.g., phenoxy, etc.), alkoxycarbonyl groups (including straight and branched chain alkyloxycarbonyl groups, e.g., n-pentyloxycarbonyl, t-pentyloxycarbonyl, n-octyloxycarbonyl, t-octyloxycarbonyl etc.), aryloxycarbonyl groups (e.g., phenoxycarbonyl, etc.), acyl groups (including straight and branched chain alkylcarbonyl groups, e.g., acetyl, stearoyl, etc.), acylamino groups (including straight and branched chain alkylcarbonylamino groups, i.e., acetamido, etc., and arylcarbonylamino groups, e.g., benzoylamino, etc.), arylamino groups (e.g., N-phenylamino, etc.), alkylamino groups (including straight and branched chain alkylamino groups, e.g., N-n-butylamino, N,N-diethylamino, etc.), carbamoyl groups (including straight and branched chain alkylcarbamoyl groups, e.g., n-butylcarbamoyl, etc.), sulfamoyl groups (including straight and branched chain alkylcarbamoyl groups, e.g., N,N-di-n-butylsulfamoyl, N-n-dodecylsulfamoyl, etc.), sulfonamido groups (including straight and branched chain alkylsulfonylamino groups, e.g., methylsulfonylamino, etc., and arylsulfonylamino groups, e.g., phenylsulfonylamino, etc.), sulfonyl groups (including straight and branched chain alkylsulfonyl groups, e.g., mesyl, etc., and arylsulfonyl groups, e.g., tosyl, etc.), cycloalkyl groups (e.g., cyclohexyl, etc.), and so on.

When $R_1$, $R_2$, $R_3$ and $R_4$ each represents an alkyl group or an aryl group, or at least either combination of $R_1$ and $R_2$ and/or $R_3$ and $R_4$ forms a 5- or 6-membered ring together with the carbon atoms to which they are attached respectively, the metal complexes represented by the general formulae, (I), (II) and (III) respectively can produce a more desirable effect. In particular, the metal complexes in which both of the combination of $R_1$ and $R_2$ and the combination of $R_3$ and $R_4$ form a 6-membered ring, especially a benzene ring, together with the carbon atoms to which they are attached are preferred over others.

M in the general formulae (I), (II) and (III) preferably represents a nickel atom, a copper atom or a cobalt atom, most preferably a nickel atom.

Z in the general formula (II) represents an organic ligand which forms a complex by entering into a combination with M via its hetero atom. Suitable examples of such a hetero atom include nitrogen, oxygen, sulfur, selenium and phosphorus. Of these atoms, nitrogen is preferred over the others.

It is to be desired that the ligand should be a mono-, di- or tri-valent molecule in order to form a complex by binding to M via nitrogen atom(s) present therein. Such nitrogen atom(s) are found in a primary, secondary or tertiary amino group, a substituted or unsubstituted imino group, a nitro group, an oxyimino group or a hydrazino group. As for the nitrogen-containing ligands, aliphatic, alicyclic, aromatic, aryl-substituted aliphatic and heterocyclic amines are perferred. Typical examples of aliphatic, alicyclic and aryl-substituted aliphatic nitrogen-containing ligands include alkylamines containing 1 to 18 carbon atoms such as methylamine, ethylamine, n-propylamine, isopropylamine, n-butylamine, n-hexylamine, n-octylamine, isooctylamine, t-octylamine, n-decylamine, n-dodecylamine, octadecylamine, etc.; alicyclic amines such as cyclopentylamine, cyclohexylamine, etc.; and benzylamine, 4-methylbenzylamine, $\alpha$- or $\beta$-phenylethylamine, and the like.

Preferred examples of secondary heterocyclic ligands containing nitrogen atom(s) as hetero atom include pyrrolidine, piperidine, pipecoline, morpholine, thiomorpholine, imidazoline, indoline, benzomorpholine, benzimidazoline, tetrahydroquinoline, and 2,2,4-trimethyltetrahydroquinoline.

Preferred example of aromatic amines include aniline; anilines having substituent group(s) on the benzene nucleus such as 2-, 3- or 4-methylaniline, chloroaniline, methoxyaniline, dichloroaniline, etc.; N-alkylanilines and N,N-dialkylanilines, such as N-methylaniline, N-ethylaniline, N,N-dimethylaniline, N,N-diethylaniline, etc.; and further, diphenylamine, 4,4'-diaminodiphenyl ether, 4,4'-diaminodiphenyl sulfide, 4,4'-diaminodiphenylsulfone, 4,4'-diaminodiphenylalkanes such as 4,4'-diaminodiphenylmethane, 4,4'-diaminodiphenylethane, etc., and 4,4'-diaminoazobenzene.

5- or 6-membered aromatic hetero rings containing nitrogen atom(s) as hetero atom may be substituted with an alkyl group containing 1 to 18 carbon atoms (preferably 1 to 4 carbon atoms), an alkoxy group containing 1 to 4 carbon atoms, cyano group, hydroxyl group, vinyl group, phenyl group, an acyl group containing 1 to 4 carbon atoms or an amino group, and/or may be fused together with a benzene nucleus to form a condensed ring, wherein the benzene nucleus may be substituted with a halogen atom, an alkyl group containing 1 to 4 carbon atoms, or an alkoxy group containing 1 to 4 carbon atoms.

Specific exampels of ligands of the above-described kind include pyrrole, 2,4-dimethylpyrrole, pyrrolidone, imidazole, 1-methylimidazole, 2-methylimidazole, 1-vinylimidazole, 2-phenylimidazole, pyrazole, 3,4-dimethyl-5-pyrazolone, triazole, pyridine, $\alpha$-, $\beta$- and $\gamma$-picoline, lutidine, collidines, parvoline, conyrines, methoxypyridines, aminopyridines (e.g., 3-aminopyridine, 2,3-diaminopyridine, and 2,6-diaminopyridine), 4-fomylpyridine, 4-cyanopyridine, pyrimidine, pyrazines, triazine, melamine, guanamines, ammeline, quinoline, 2-ethylquinoline, isoquinoline, quinaldine, quinazoline, quinoxaline, phthalazine, quinoline, indolizine, indoles (e.g., 2-methylindole, 2-phenylindole, etc.), benzimidazole, 2-methylbenzimidazole, 2-stearylbenzimidazole, 2-aminobenzimidazole, benzoxazole, benzothiazole, 2-thiobenzothiazole, 2-aminobenzothiazole, benzotriazole, carbazole, acridine, phenazine, antipyrine, diguanamine, guanidine, bipyridyl, 2,6-(di-2-pyridyl)pyridine (or terpyridyl),phenanthridine, phenanthroline, and dipyridylketone.

Further, an organic ligand represented by Z can be bidentate or tridentate (i.e., bifunctional or trifunctional) nitrogen-containing molecule. Suitable examples of ligands of these kinds include alkylenediamines such as ethylenediamine, propylenediamine, etc., phenylenediamines, dialkylenetriamines and triaminoalkanes. Specific examples of dialkylene triamines include diethylenetriamine, monoethylene/monopropylene triamine, dipropylenetriamine, and N-alkyl derivatives of these triamines; and those of triaminoalkanes include $\alpha,\beta,\gamma$-triaminopropane, $\alpha,\beta,\gamma$-triaminobutane, and $\alpha,\gamma$-diamino-$\beta$-(aminoethyl)propane.

Plural nitrogen atoms attached to metal, and plural carbon atoms bonded to these nitrogen atoms can form one heterocyclic ring or one heterocyclic ring system. The representatives of bidentate nitroge-containing ligands of such a type are piperazine, imidazoline, and diazobicyclo[2,2,2]-octane.

Other compounds preferred as a nitrogen-containing ligand include hydrazines such as hydrazine, an alkylhydrazine whose alkyl moiety contains 1 to 5 carbon atoms, an arylhydrazine (e.g., phenylhydrazine), etc.; hydrazones such as acetone hydrazone, acetophenone hydrazone, etc.; hydrazides such as acetohydrazide, benzohydrazide, etc.; hydroxylamines; amidines such as formamidine, etc.; amides such as formamide, dimethylformamide, tetramethylurea, acetamide, benzamide, etc.; and oximes such as acetoaldoxime, acetoxime, etc.

The ligand Z in the organometallic compounds of the present invention can also be one which enters into coordination to metal via oxygen, sulfur or phosphorus atom(s) contained therein.

Suitable examples of organic ligands capable of entering into coordination to metal via oxygen or sulfur atom(s) include carbonyl compounds such as benzophenone, acetylacetone, pyrone, etc.; amine oxides; phosphine oxides such as triphenylphosphine oxide, etc.; thiocarbonyl compounds such as urea, thiourea, etc.; and substitution products of these compounds, such as 4,4'-bis(dimethylamino)benzophenone (Michler's ketone), etc. In addition, mercaptanes such as 2-mercaptobenzothiazole and the like, and thiones such as 1,3-dimethylimidazoline-2-thione and the like can be used as sulfur-containing ligands. As examples of organic ligands capable of entering into coordination to metal via a phosphorus atom, mention may be made of phosphines such as triphenylphosphine, etc.

Of the metal complexes concerned in the present invention, which are represented by the general formulae (I), (II) and (III) respectively, those favored over others are represented by the following general formulae (Ia), (IIa) and (IIIa), respectively.

(Ia)

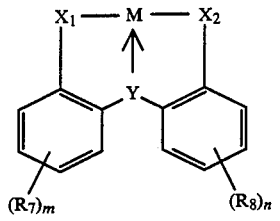

(IIa)

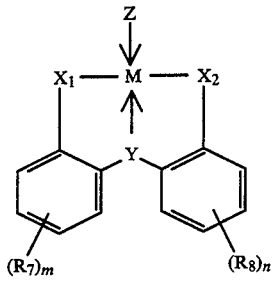

(IIIa)

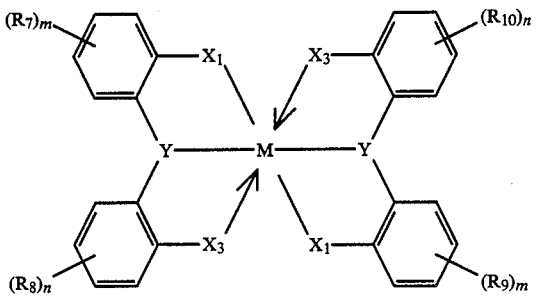

In the foregoing general formulae (Ia), (IIa) and (IIIa), $X_1$, $X_2$, $X_3$, Y and Z have the same meanings as in the general formulae (I) (II) and (III). As for the metal represented by M, nickel is particularly preferred.

In the general formulae (Ia), (IIa) and IIIa), $R_7$, $R_8$, $R_9$ and $R_{10}$ each represents an alkyl group (including those having a straight or branched chain structure and containing 1 to 20 carbon atoms, e.g., methyl, ethyl, n-propyl, n-butyl, n-octyl, t-octyl, n-hexadecyl, etc.), an aryl group (e.g., phenyl, naphthyl, etc.), an alkoxy group (including those having a straight or branched chain structure, e.g., methoxy, n-butoxy, t-butoxy, etc.), an aryloxy group (e.g., phenoxy, etc.), an alkoxycarbonyl group (including those having a straight or branched chain structure, e.g., n-pentyloxycarbonyl, t-pentyloxycarbonyl, n-octyloxycarbonyl, t-octyloxycarbonyl, etc.), an aryloxycarbonyl group (e.g., phenoxycarbonyl, etc.), an acyl group (including a straight or branched chain alkylcarbonyl group, e.g., acetyl, stearoyl, etc.), an acylamino group (including straight or branched chain alkylcarbonylamino groups, e.g., acetamido, etc., and arylcarbony.lamino groups, e.g., benzoylamino, etc.), an arylamino group (e.g., N-phenylamino, etc.), an alkylamino group (including those having a straight or branched chain structure, e.g., N-n-butylamino, N,N-diethylamino, etc.), a carbamoyl group (including straight or branched chain alkylcarbamoyl groups, e.g., n-butylcarbamoyl, etc.), a sulfamoyl group (including straight or branched chain alkylsulfamoyl groups, e.g., N,N-di-n-butylsulfamoyl, N-n-dodecylsulfamoyl, etc.), a sulfonamido group (including straight or branched chain alkylsulfonyl groups, e.g., methylsulfonylamino, etc., and arylsulfonylamino groups, e.g., phenylsulfonylamino, etc.), a sulfonyl group (including straight or branched chain alkylsulfonyl groups, e.g., mesyl, etc., and arylsulfonyl groups, e.g., tosyl, etc.), or a cycloalkyl group (e.g., cyclohexyl, etc.). m and n each represents an integer of 0 to 4.

Specific examples of the compounds of the present invention are illustrated below. However, the invention should not be construed as being limited to these examples.

(1)

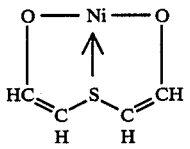

(2)

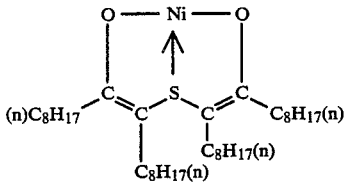

(3)

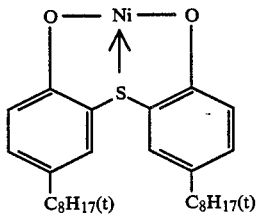

-continued
(4)
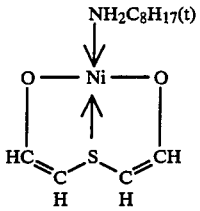
(5)
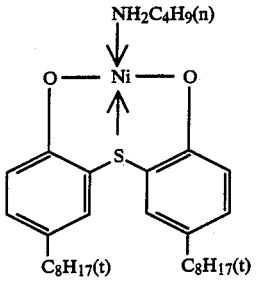
(6)
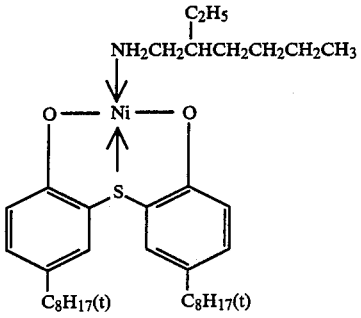
(7)
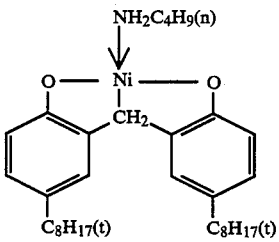
(8)
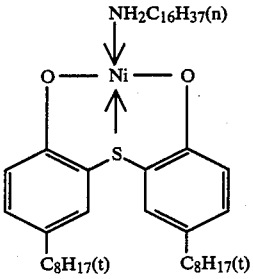
(9)
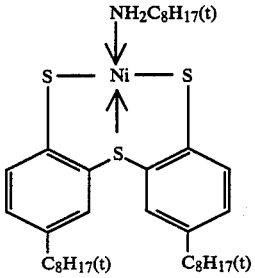

-continued
(10)
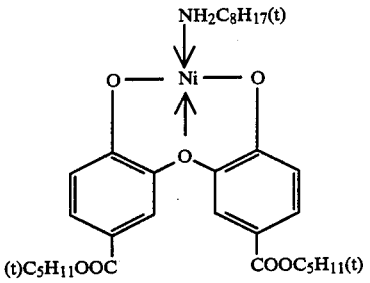
(11)
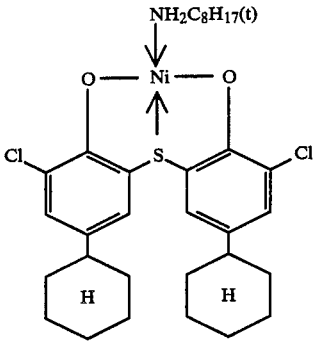
(12)
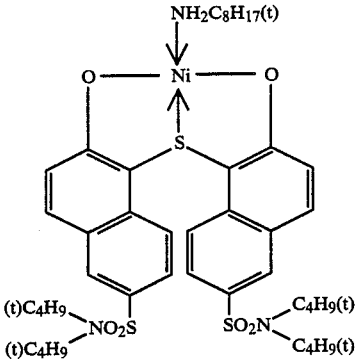
(13)
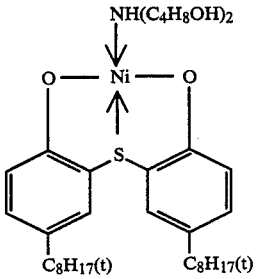
(14)
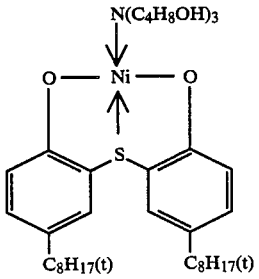

-continued (15)

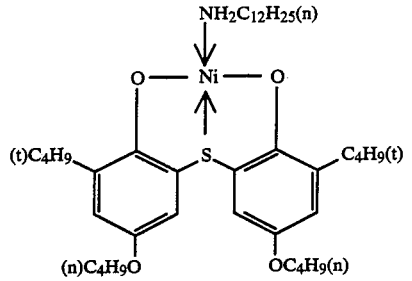

(16)

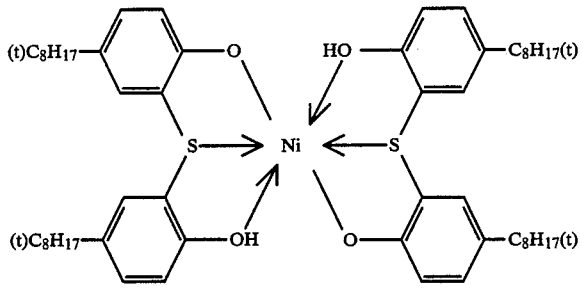

(17)

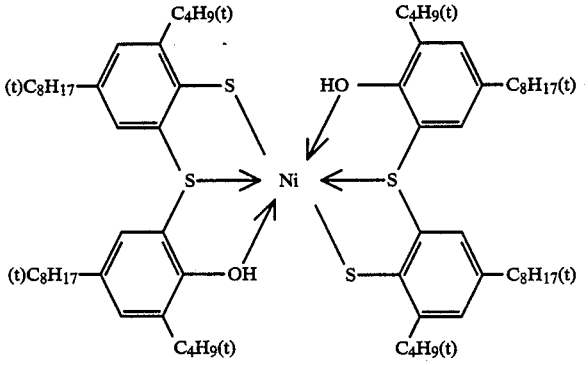

(18)

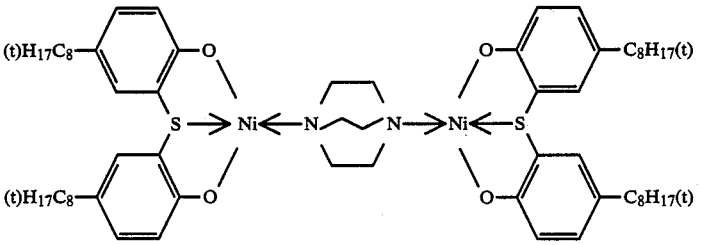

The above-cited complexes can be synthesized according to the methods described in British Patent No. 858,890, Germany Patent Application (OLS) No. 2,042,652, and so on.

Each of these complexes is used in a proportion of preferably 1 to 200 wt %, particularly preferably to to 100 wt %, to a color developer used. Each of these organometallic compounds is added to a dispersion of a color developer, which is described below, and then coated to prepare a color developer sheet.

As for the color developers which are allowed to react with color formers to be used in the recording sheet of the present invention, those represented by the following general formulae (IV) to (VI) are preferred:

(IV)

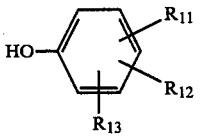

In the above general formula (IV), $R_{11}$ and $R_{12}$ which may be the same or different, each represents a hydrogen atom, an alkyl group, an alkoxy group, an aryl group, an arylsulfonyl group, an alkoxycarbonyl group, or a halogen atom. $R_{13}$ represents a hydrogen atom, or a group represented by the following general formula (IVa)

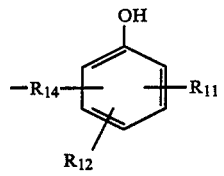

(IVa)

wherein $R_{11}$ and $R_{12}$ have the same meanings as in the foregoing general formula (IV), respectively; $R_{14}$ represents a divalent group containing 1 to 12 carbon atoms, or $SO_2$.

Of the compounds represented by the foregoing general formula (IV), those containing a hydrogen atom $R_{13}$ and a hydrogen atom or an alkoxycarbonyl group as $R_{11}$ and $R_{12}$ each, and those containing the group represented by the general formula (IVa) as $R_{13}$, and an alkylene group containing 3 to 12 carbon atoms, a cycloalkylene group containing 5 to 7 carbon atoms, an aralkylene group containing 8 to 12 carbon atoms, or $SO_2$ as $R_{14}$ are favored over others.

The term "alkyl group" as used in the foregoing general formula is intended to include saturated or unsaturated alkyl, and cycloalkyl groups. These groups may be substituted with an aryl group, an alkoxy group, an aryloxy group, a halogen atom, or a cyano group.

Specific examples of the compound represented by general formula (IV) include 4-phenylphenol, bisphenol sulfone, p-phenylsulfonylphenol, p-tolylsulfonylphenol, bis(3-vinyl-4-hydroxyphenyl)sulfone, 2,2-bis(3-vinyl-4-hydroxyphenyl)propane, bis-3-allyl-4-hydroxyphenylsulfone, hexyl-4-hydroxybenzoate, 2,2'-dihydroxybiphenyl, 4-t-butylphenol, 4-t-octylphenol, 4-chlorophenylphenol, 2,2-bis(3-hydroxyphenyl)propane, 4,4'-isopylidenebis)-2-methylphenol), 1,1-bis(3-chloro-4-hydroxyphenyl)cyclohexane, 1,1-bis(3-chloro-4-hydroxyphenyl)-2-ethylbutane, 4,4'-sec-isooctylidenediphenol, 4,4'-sec-butylidenediphenol, 4-p-methylphenylphenol, 4,4'-isopentylidenediphenol, 4,4'methylcyclohexylidenediphenol, 4,4-dihydroxydiphenylsulfide, 1,4-bis(4'-hydroxycumyl)benzene, 1,3-bis)4'-hydroxycumyl)benzene, 4,4'-thiobis(6-tert-butyl-3-methylphenol), 4,4'-dihydroxydiphenylsulfone, hydroquinone monobenzyl ether, 4-hydroxybenzophenone, 2,4-dihydroxybenzophenone, polyvinylbenzyloxycarbonylphenol, 2,4,4'-trihydroxybenzophenone, 2,2',4,4'-tetrahydroxybenzophenone, dimethyl 4-hydroxyphthalate, methyl 4-hydroxybenzoate, 2,4,4'-trihydroxydiphenylsulfone, 1,5-bis-p-hydroxyphenylpentane, 1,6-bis-p-hydroxyphenoxyhexane, tolyl 4-hydroxybenzoate, α-phenylbenzyl 4-hydroxybenzoate, phenylpropyl 4-hydroxybenzoate, phenetyl 4-hydroxybenzoate, p-chlorobenzyl 4-hydroxybenzoate, p-methoxybenzyl 4-hydroxybenzoate, benzyl 4-hydroxybenzoate, m-chlorobenzyl 4-hydroxybenzoate, β-phenetyl 4-hydroxybenzoate, 4-hydroxy-2',4'-dimethyldiphenylsulfone, β-phenetylorsellinate, cinnamyl orsellinate, o-chlorophenoxyethyl orsellinate, o-ethylphenoxyethyl orsellinate, o-ethylphenoxyethyl orsellinate, m-phenylphenoxyethyl orsellinate, β-3'-t-bityl-4'-hydroxyphenoxyethyl 2,4-dihydroxybenzoate, 1-t-butyl-4-p-hydroyphenylsulfonyloxybenzene, 4-N-benzylsulfamoylphenol, p-methylbenzyl 2,4-dihydroxybenzoate, β-phenoxyethyl 2,4-dihydroxybenzoate, benzyl 2,4-dihydroxy-6-methylbenzoate, methyl bis-4-hydroxyphenylacetate, β-phenoxybutyl p-hydroxybenzoate, δ-phenoxybutyl p-hydroxybenzoate, β-p-methoxyphenoxyethyl 2,4,6-trihydroxybenzoate, β-p-butoxyphenoxyisopropyl p-hydroxybenzoate, β-p-methoxyphenoxyethoxyethyl 2,4-dihydroxybenzoate, phenoxybutyl orsellinate, p-methoxyphenoxyethyl β-resorcylate, β-p-methoxyphenoxyethoxyethyl orsellinate, β-o-methoxyphenoxyethyl orsellinate, tolyloxyethyl orsellinate, β-p-methoxyphenoxypropyl orsellinate, phenoxyethyl β-resorcylate, δ-p-methoxyphenoxybutyl β-resorcylate, and so on.

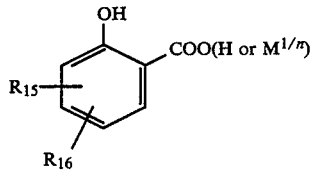

(V)

In the above general formula, $R_{15}$ represents a hydrogen atom, an aryl group or an alkyl group; $R_{16}$ represents an alkyl group, an alkoxy group, an aryl group, or a halogen atom; M represents a n-valent metal atom; and n represents an integer of 1 to 3.

Therein, the term "alkyl group" is intended to include saturated or unsaturated alkyl and cycloalkyl groups, which each may be substituted with an aryl groups, an alkoxy group, an aryloxy group, a halogen atom, an acylamino group, an aminocarbonyl group, cyano group or so on. The term "aryl group" is intended to include phenyl groups, naphthyl groups and heterocyclic aromatic ring residues, which each may be substituted with an alkyl group, an alkoxy group, an aryloxy group, a halogen atom, a nitro group, a cyano group, a substituted carbamoyl group, a substituted sulfamoyl group, a substituted amino group, a substituted oxycarbonyl group, a substituted oxysulfonyl group, a thioalkoxy group, an arylsulfonyl group, a phenyl group, or so on.

Of the substituent groups represented by $R_{15}$ in the foregoing formula, a hydrogen atom, a phenyl group and an alkyl group containing 1 to 22 carbon atoms are preferred over others. As for those represented by $R_{16}$, an alkyl group containing 1 to 22 carbon atoms, an alkoxy group containing 1 to 20 carbon atoms, a chlorine atom and a fluorine atom are preferred. As for the metal atom represented by M, zinc, aluminum, magnesium and calcium are favored.

Of the substituents with which alkyl and alkoxy groups represented by $R_{16}$ may be substituted, an aryl group containing 6 to 12 carbon atoms, an aryloxy group containing 6 to 16 carbon atoms, an alkoxy group containing 1 to 12 carbon atoms, a halogen atom and an alkoxycarbonyl group are preferred over others.

Since salicylic acid derivatives concerned in the present invention should be insoluble in water, those with a total of not less than 14, particularly not less than 16, carbon atoms are preferably employed. These derivatives can be used in the form of metal salt, or in such a condition that they are made to be present together with, for example, zinc oxide in a dispersion to bring about the salt formation, the adsorption or the double decomposition therein.

Specific examples of salicylic acid derivatives which can be preferably used include 4-pentadecylsalicylic acid, 3-phenylsalicylic acid, 3-cyclohexylsalicylic acid, 3,5-di-t-butylsalicylic acid, 3,5-didodecylsalicylic acid, 3-methyl-5-benzylsalicylic acid, 3-phenyl-5-(α,α-dimethylbenzyl)salicylic acid, 3,5-bis(α-methylbenzyl)salicylic acid, 3,5-di-t-octylsalicylic acid, 5-tetradecylsalicylic acid, 5-hexadecylsalicylic acid, 5-octadecylsalicylic acid, 5-α-(p-α-methylbenzylphenyl)-ethylsalicylic acid, 4-dodecyloxysalicylic acid, 4-tetradecyloxysalicylic acid, 4-hexadecyloxysalicylic acid, 4-β-phenoxyethoxysalicylic acid, 4-β-p-tolyloxyethoxysalicylic acid, 4-β-p-ethylphenoxyethoxysalicylic acid, 4-β-p-methoxyphenoxyethoxysalicylic acid, 4-β-p-ethoxyphenoxyethoxysalicylic acid, 4-β-m-tolyloxyethoxysalicylic acid, 4-β-o-tolyloxyethoxysalicylic acid, 4-(β-phenoxyoctyloxy)salicylic acid, 3-xylyl-5-(α,α-dimethylbenzyl)-salicylic acid, 2-hydroxy-1-α-ethylbenzyl-3-naphtoic acid, 3,5-dicyclopentadienylsalicylic acid, carboxy-denatured terpenephenol resin, and so on.

$$(R_{17})_2Zn(A)_2 \quad (VI)$$

In the above formula, $R_{17}$ represents a monovalent or polyvalent, colorless organic ligand to form a complex by bonding to zinc ion via its hetero atom, and A represents SCN, Cl, or abbenzoic acid anion with an atom-attracting group.

Of the colorless organic ligands represented by $R_{17}$, pyridine, imidazole, quinoline, benzothiazole, benzimidazole and antipyrine ligands are favored over others. These ligands each may be substituted with an alkyl group, a cyano group, an alkoxy group, a phenyl group, an amino group, a formyl group, a vinyl group, or/and so on.

Suitable examples of the foregoing zinc complexes include those prepared from zinc rhodanide and ligands, such as imidazole, 2-phenylimidazole, picoline, pyridine, 2-benzylimidazole, benzimidazole, 2,3-dimethyl-1-phenyl-3-pyrazoline-5-one, 1-phenyl-2-methyl-3-benzyl-3-pyrazoline-5-one, 1-phenyl-2-methyl-3-(2-ethylhexyl)-3-pyrazoline-5-one, 1-phenyl-2-methyl-3-isopropyl-3-pyrazoline-5-one, 1-phenyl-2,3-dibenzyl-pyrazoline-5-one, 1-phenyl-2-benzyl-3-methyl-pyrazoline-5-one, etc.

In addition to the color developers represented by the formulae (IV) to (VI), acetylacetone complex of molybdate, ditolylthiourea, 4,4'-diacetyldiphenylthiourea, novolak resin, metal-processed novolak resin, p-phenylphenol-formaldehyde resin, p-butylphenol-acetylene resin, inorganic acids, acid clay, activated clay, attapulgite, colloidal silica, aluminum silicate, magnesium silicate, zinc silicate, tin silicate, zinc rhodanide, zinc chloride, iron stearate, cobalt naphthenate, nickel peroxide, ammonium nitrate, bentonite, oxalic acid, maleic acid, tartaric acid, citric acid, succinic acid, stearic acid, and so on.

These color developers can also be used as a mixture of two or more thereof.

There is no particular restriction as to color formers which can produce colors by contact with the color developer sheet of the present invention. As examples of color formers which can be used in the present invention, mention may be made of triarylmethane compounds, diphenylmethane compounds, xanthene compounds, thiazine compounds, spiro compounds, indolyl-(aza)phtahlide compounds, leucoauramine compounds, Rhodamine lactam compounds, triphenylmethane compounds, triazene compounds, spiro-pyran compounds, fluorene compounds, and so on. These compounds may be used as a mixture of two or more thereof.

Specific examples of phthalides are described in U.S. Pat. No. Re. 23,024, U.S. Pat. Nos. 3,491,111, 3,491,112, 3,491,116 and 3,509,174, those of fluoranes in U.S. Pat. 3,624,107, 3,627,787, 3,641,011, 3,462,828, 2,681,390, 3,920,510 and 3,959,571, those of spiro-dipyrans in U.S. Pat. No. 3,971,808, those of coloring compounds of pyridine and pyrazine types in U.S. Pat. Nos. 3,775,424, 3,853,869 and 4,246,318, and those of flourene compounds in Japanese Patent Application No. 2409/86, and so on.

Examples illustrating the several kinds of colorless dyes that can be used include triarylmethane compounds such as 3,3-bis(p-dimethylaminophenyl)-6-dimethylaminophthalide (or Crystal Violet lactone), 3,3-bis(p-dimethylaminophenyl)phthalide, 3-(2-ethoxy-4-diethylaminophenyl)-3-(1-ethyl-2-methylindole-3-yl)phthalide, 3-(2-ethoxy-4-diethylaminophenyl)-3-(1-octyl-2-methylindole-3-yl)phthalide, 3-(2-ethoxy-4-diethylaminophenyl)-3-(1-octyl-2-methylindole-3-yl)azaphthalide, and the like. As for the diphenylmethane compounds, 4,4'-bis-dimethylaminobenzhydrine benzyl ether, N-halophenyl-leucoaurmine, N-2,4,5-trichlorophenyl-leucoauramine and the like can be included. As for the xanthene compounds, Rhodamine-B-anilinolactam, Rhodamine (p-nitroanilino)lactam, Rhodamine B (p-chloroanilino)lactam, 2dibenzlamino-6-diethylaminofluoran, 2-anilino-6-diethylaminofluoran, 2-anilino-3-methyl-6-diethylaminofluoran, 2-anilino-3-methyl-6-cyclohexylmethylaminofluoran, 2-o-chloroanilino-6-diethylaminofluoran, 2-m-chloroanilino-6-diethylaminofluoran, 2-(3,4-dichloroanilino)-6-diethylaminofluoran, 2-octylamino-6-dietylaminofluoran, 2-dihexylamino-6-diethylaminofluoran, 2-m-trifluoromethylanilino-6-diethylaminofluoran, 2-butylamino-3-chloro-6-diethylaminofluoran, 2-ethoxyethylamino-3-chloro-6-diehtylaminofluoran, 2-p-chloroanilino-3-methyl-6-dibutylaminofluoran, 2-anilino-3-methyl-6-dioctylaminofluoran, 2-anilino-3-chloro-6-diethylaminofluoran, 2-diphenylamino-6-diethylaminofluoran, 2-anilino-3-methyl-6-diphenylaminofluoran, 2-phenyl-6-diethylaminofluoran, 2-anilino-3-methyl-6-N-ethyl-N-isoamylaminofluoran, 2-anilino-3-methyl-5-chloro-6-diethylaminofluoran, 2-anilino-3-methyl-6-diethylamino-7-methylfluoran, 2-anilino-3-methoxy-6-dibutylaminofluoran, 2-o-chloroanilino-6-dibutylaminofluoran, 2-p-chloroanilino-3-ethoxy-6-N-ethyl-N-isoamylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-anilino-3-methyl-4',5'-dichlorofluoran, 2-o-toluidino-3-methyl-6-diisopropylamino-4',5'-dimathylaminofluoran, 2-anilino-3-ethyl-6-N-ethyl-N-isoamylaminofluoran, 2-anilino-3-methyl-6-N-ethyl-N-γ-methoxypropylaminofluoran, 2-anilino-3-chloro-6-N-ethyl-N-isoamylaminofluoran, and the like can be included. As for the thiazine compounds, benzoyl Leucomethylene Blue, p-nitrobenzyl Leucomethylene Blue, and the like can be included. As for the spiro compounds, 3-methyl-spiro-dinaphthopyran, 3-ethyl-spiro-dinaphthopyran, 3,3'-dichlorospiro-dinaphthopyran, 3-benzyl-spiro-dinaphthbpyran, 3-methyl-naphto-(3-methoxybenzo)spiropyran, 3-propylspiro-dibenzopyran and the like can be included.

These color formers are dissolved in a solvent or ground to fine powder, dispersed into a binder or enmicrocapsulated, and then coated on a support. The thus obtained coat is brought into contact with the color developer sheet of the present invention under applied heat or pressure.

A usage of the color developer is described below.

The color developer is dispersed mechanically into an aqueous system with a ball mill, an attriter, a sand mill or the like to prepare a coating composition (A).

Therein, to add an inorganic pigment together with the color developer can produce a desirable effect on improvements in dispersing efficiency and color developability.

On the other hand, the, color developer is dissolved in an organic solvent, and emulsified in water with a stirrer to prepare a coating composition (B).

Therein, the addition of an ionic or nonionic surface active agent and a water-soluble macromolecule has an advantage in that a stable emulsion can be prepared in a short time. In preparing the coating composition, an inorganic pigment is additionally used to bring about desirable effects on improvements in coating facility, covering power, color developability, and so on.

As examples of suitable organic solvents, mention may be made of aliphatic and aromatic esters, biphenyl derivatives, naphthalene derivatives, biphenylalkanes, and so on. Specifically, methylamyl acetate (1,3-dimethylbutyl acetate), 2-ethylbutyl acetate, 2-ethylhexyl acetate, amyl propiolate, isobutyl iso-butyrate, 2,2,4-trimethyl-1,3-pentanediol monoisobutyrate, 2,2,4-trimethyl-1,3-pentanediol diisobutyrate, 2,4-dimethyl-2,4-pentanediol diacetate, 2,2-dimethyl-1,3-butanediol diisobutyrate, 2-methyl-2,4-pentanediol dipropionate, 2,3,3,4-tetramethyl-2,4-pentanediol monoacetate, amyl lactate, 2-methylbiphenyl, 3-methylbiphenyl, 3,3-dimethylbiphenyl, 2,4-dimethylbiphenyl, 2,6-dimethylbiphenyl, 2,4,6-trimethylbiphenyl, cyclohexylbenzene, bicyclohexylbenzene, monoisopropylbiphenyl, monoisopropylnaphthalene, diisopropylnaphthalene, 1-isopropiophenyl-2-phenylethane, 1-isopropylphenyl-1-phenylethane, 1,1-ditolylethane, 1-ethylphenyl-1-phenylethane, 1-phenyl-1-xylylethane, and so on can be used.

Poor solvents, such as petroleum fractions having a boiling point of 150° C. to 310° C., etc., can be used as a diluent in combination with the above-cited solvents.

As suitable examples of inorganic pigments, mention may be made of oxides, hydroxides, carbonates and silicates of polyvalent metals such as magnesium, aluminium, calcium, titanium, manganese, nickel, zinc, zirconium, molybdenum, tin, antimony, lead, etc., (including, e.g., zinc oxide, calcium oxide, titanium oxide, zinc hydroxide, magnesium hydroxide, aluminium hydroxide, magnesium carbonate, calcium carbonate, aluminium silicate, and so on); kaolin; talc; activated clay; and so on.

It is to be desired that the organometallic compounds of the present invention should be used together with a color developer in the coating composition (A) or the coating composition (B).

The coating composition (A), the coating composition (B) or a composition obtained by mixing the coating compositions (A) and (B) in an arbitrary ratio, to which a binder is further added, is coated on a support to prepare a color developer sheet.

Suitable examples of binders which can be used therein include synthetic and natural high molecular substances generally known in this art, such as latexes like styrene-butadiene copolymer latex, polyvinyl alcohol, maleic anhydride-isobutylene copolymers, starch, casein, gum arabic, gelatin, carboxymethyl cellulose, methyl cellulose, etc.

Typical examples of the support which can be used in the present invention include a paper, a synthetic paper, a polymer film, etc.

An appropriate final amount of the organic color developer coated on a support is within the range of 0.1 $g/m^2$ to 3.0 $g/m^2$, preferably 0.2 $g/m^2$ to 1.0 $g/m^2$.

The color developer sheet according to the present invention can be used for various recording materials such as a pressure-sensitive recording sheet, a heat-sensitive recording sheet, a heat-transfer recording sheet and the like. However, the use of the color developer sheet of the present invention is not limited thereto.

Now, the color developer sheet of the present invention, which is to be used for pressures-sensitive copy, is illustrated in concrete terms by reference to the following examples. However, the invention is not to be construed as being limited to the examples.

Additionally, in the following examples, all parts, percents and ratios are by weight unless otherwise indicated.

PREPARATION OF COLOR FORMER SHEET

A color former oil prepared by dissolving 6 parts of 3-(3-ethoxy-4b-diethylaminophenyl)-3-(1-octyl-2-methylindole-3-yl)phthalide in 100 parts of diisopropylnaphthalene (KMC, trade name, the product of Kureha Chemical Industry Co., Ltd.) was emulsified and dispersed into 100 parts of a 4.4% water solution of partial sodium salt of polyvinylbenzenesulfonic acid (mean molecular weight: 500,000), which was adjusted to pH 6.0, to form o/w type emulsion with a mean droplet size of 5.5 microns. Separately, 6 parts of melamine, 11 parts of a 37% water solution of formaldehyde, and 83 parts of water were heated to 60° C. for 30 minutes with stirring, and thereby a transparent water solution containing the mixture of melamine, formaldehyde and an initial condensate of melamine and formaldehyde was obtained. The water solution of the mixture was admixed with the foregoing emulsion, and adjusted to pH 6.0 by adding a 20% water solution of acetic acid with stirring. The resulting mixture was heated to 65° C., and kept at that temperature for 30 minutes to force the enmicrocapsulation to completion.

To the thus obtained microcapsule solution were added 200 parts of a 20% water solution of etherified starch, 47 parts of starch granules (means granule size: 40 microns) and 10 parts of talc.

Then, water was added so as to control the solids concentration in the microcapsule solution to 20%.

The resulting microcapsule solution was coated on base paper (a high-grade paper) with a basis weight of 40 $g/m^2$ using an air-knife coater so as to have a dry coverage of 5 $g/m^2$, and then dried to prepare a microcapsule sheet.

EXAMPLES 1 TO 5

Ten parts of zinc 3,5-bis-α-methylbenzylsalicylate and 5 parts of the compound set forth in Table 1 were admixed with 20 parts of 1-isopropylphenyl-2-phenylethane, and the mixture was converted into a solution by heating to 90° C. The solution was added to 50 parts of a 2% water solution of polyvinyl alcohol (PVA-205, trade name, the product of Kuraray Co., Ltd.), and thereto was added 0.1 part of a 10% water solution of sodium sulfosuccinate as a surface active agent. The resulting solution was emulsified with a homogenizer so as to have a mean droplet size of 3 microns.

Then, 20 parts of zinc oxide and 1 part of sodium hexametaphosphate were dispersed into 100 parts of water with a Kedy mill to prepare a dispersion. Further, another dispersion was prepared by dispersing 80 parts of aluminium hydroxide into 100 parts of water containing 1 part of sodium hexametaphosphate with a sand grinder until the ground particles had a mean size of 4.5 microns. These dispersions were mixed with the above-described emulsion, and thereto was added as a binder a mixture of 100 parts of a 10% water solution of PVA-110 (produced by Kuraray Co., Ltd.) and 10 parts (on a solids basis) of carboxy-denatured SBR latex (SN-307, trade name, the product of Sumitomo Naugatuc Co., Ltd.). Further, water was added so as to adjust a solids concentration to 20% to prepare the coating composition (A).

Separately, 10 parts of zinc 3,5-bis-α-methylbenzylsalicylate, 20 parts of zinc oxide and 1 part of sodium hexametaphosphate were dispersed homogeneously into 100 parts of water with a sand grinder so as to have a mean particle size of 3 microns. The thus obtained dispersion was named (D).

To the dispersion (D) was added to dispersion obtained by dispersing 80 parts of aluminium hydroxide into 100 parts of water containing 1 part of sodium hexametaphosphate with a sand grinder until the ground particles had a mean size of 4.5 microns, and thereto were further added 100 parts of a 10% water solution of PVA-110 (produced by Kuraray Co., Ltd.) and 10 parts (on a solids basis) of carboxydenatured SBR latex (SN-307, trade name, the product of Sumitomo Naugatuc Co., Ltd.). Furthermore, water was added so as to adjust a solids concentration to 20% to prepare the coating composition (B).

The coating composition (A) and the coating composition (B) were mixed in a (A)/(B) ratio of 50/50, based on zinc 3,5-bis-α-methylbenzylsalicylate, to prepare the coating composition (C).

The coating composition (C) was coated on base paper with a basis weight of 50 g/m$^2$ at a solids coverage of 5.0 g/m$^2$ using an air-knife coater, and then dried to prepare a color developer sheet.

EXAMPLES 6 TO 10

Color developer sheets were prepared in the same manner as in Examples 1 to 5, except that 5 parts of the compound set forth in Table 1 was used at the time of preparation of the dispersion (D) instead of using the organometallic compound of the present invention in the coating composition (A).

EXAMPLES 11 TO 15

Color developer sheets were prepared in the same manner as in Examples 1 to 5, except that amounts of the organometallic compound of the present invention to be added to the color developer were changed by using the coating composition (A) used in Example 2, the coating composition (B) used in Example 7, the organometallic compound-free coating composition (A') and the organometallic compound-free coating composition (B') in prescribed ratios.

COMPARATIVE EXAMPLE

A color developer sheet was prepared in the same manner as in Examples 1 to 4, except the additive of the present invention was not used.

COMPARISON TESTS (1) Light Fastness of Developed color:

The color former sheet was superposed on each of the color developer sheets obtained in Examples and Comparative Example, and thereto was applied a pressure of 300 kg/cm$^2$ to cause coloration. These sheets were allowed to stand for 24 hours in the dark. Then, a spectral absorption curve of the developed color was measured within the wavelength range of 380 to 780 nm, and the density at the absorption maximum (fresh density ($D_o$)) was determined.

The developed color was exposed to a xenon fade-m-meter (Suga testing machine, Model FAL-25AX-HC) for 16 hours, and then the spectral absorption curve of the resulting color was measure, and the density at the absorption maximum ($D_1$) was determined.

The measurement of the spectral absorption curve was performed with a Hitachi Color Analizer Model 307, and light resistance values were determined according to the following equation, and shown in Table 1.

$$\text{Light resistance value} = \frac{\text{Density at the absorption maximum after exposure } (D_1)}{\text{Fresh Density at the absorption maximum } (D_0)}$$

The above equation means that the developed color is more excellent in light resistance the greater the value becomes.

(2) Stability:

Color developer sheets prepared in the examples and the comparative example, which had been exposed in advance to the above-described xenon fade-o-meter for 8 hours, were made to take part in color development under the above-described condition, and allowed to stand for 24 hours in the dark. Thereafter, spectral absorption curves of the developed colors were measured in the wavelength range of 380 to 870 nm, and densities at their respective absorption maxima after aging ($D_2$) were determined.

$$\text{Stability Value} = \frac{\text{Density of the color product obtained by printing after exposure to xenon fade-o-meter at the absorption maximum } (D_2)}{\text{Density of the color product obtained without undergoing exposure to xenon fade-o-meter at the absorption maximum } (D_0)}$$

The above definition means that the color product is the more excellent in stability with the elapse of time (stability maintenance) the greater the value obtained is.

The results of the above tests are shown in Table 1 below.

TABLE 1

| | Organometallic Compound | | | Light | |
|---|---|---|---|---|---|
| | Compound Number | Coating Composition Used | Proportion to Color Developer | Resistance of Color Product | Stability Maintenance |
| Example | | | | | |
| 1 | (2) | (A) | 25 wt % | 0.66 | 0.79 |

TABLE 1-continued

| | Organometallic Compound | | | Light | |
|---|---|---|---|---|---|
| | Compound Number | Coating Composition Used | Proportion to Color Developer | Resistance of Color Product | Stability Maintenance |
| 2 | (5) | " | " | 0.76 | 0.93 |
| 3 | (7) | " | " | 0.77 | 0.90 |
| 4 | (12) | " | " | 0.74 | 0.91 |
| 5 | (16) | " | " | 0.73 | 0.89 |
| 6 | (2) | (B) | " | 0.64 | 0.89 |
| 7 | (5) | " | " | 0.74 | 0.92 |
| 8 | (10) | " | " | 0.75 | 0.88 |
| 9 | (13) | " | " | 0.74 | 0.89 |
| 10 | (18) | " | " | 0.74 | 0.90 |
| 11 | (5) | (A) + (B) (1:1) | 50 wt % | 0.79 | 0.94 |
| 12 | " | " | 25 wt % | 0.75 | 0.94 |
| 13 | " | " | 10 wt % | 0.65 | 0.91 |
| 14 | " | " | 5 wt % | 0.63 | 0.84 |
| 15 | " | " | 2 wt % | 0.54 | 0.78 |
| Comparative Example | Absent | — | Absent | 0.49 | 0.75 |

As can be seen from the data in Table 1, the color developer sheets of the present invention were superior to the comparative one in both light resistance and stability maintenance of the developed color.

While the invention has been described detail and with reference to specific embodiments thereof, it will be apparent to one skilled in the art that various changes and modifications can be made therein without departing from the spirit and scope thereof.

What is claimed is:

1. A color developer sheet which brings about color development by contact with a substantially colorless electron-donating color former, where the sheet contains an organometallic compound represented by the following general formula (II) or (III):

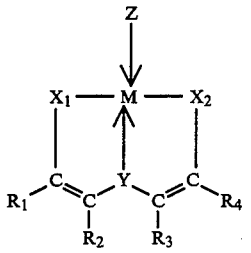

(II)

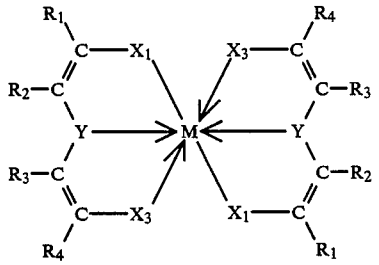

(III)

wherein M represents a nickel atom, a copper atom, a cobalt atom, or a zinc atom; $X_1$ and $X_2$ each represents an oxygen atom, a sulfur atom, or —$NR_5$—, in which, $R_5$ represents a hydrogen atom, an alkyl group, an aryl group, or a hydroxy group; $X_3$ represents a hydroxyl group, or a mercapto group; Y represents an oxygen atom, a sulfur atom, or —$CHR_6$, in which, $R_6$ represents a hydrogen atom, an alkyl group, or an aryl group; $R_1$, $R_2$, $R_3$ and $R_4$ each represents a hydrogen atom, a halogen atom, a cyano group, or an alkyl, aryl, cycloalkyl or heterocyclyl group attached to the carbon atom directly or via a divalent linkage group, or at least either combination of $R_1$ and $R_2$ and/or $R_3$ and $R_4$ may be connected to each other to form a 5- or 6-membered ring together with the carbon atoms; and Z represents an organic ligand which is mono-, di- or trivalent, contains nitrogen, and forms a complex by binding to M via its hetero atom.

2. A color developer sheet as in claim 1, wherein $X_1$ and $X_2$ each represents an oxygen atom or a sulfur atom.

3. A color developer sheet as in claim 1, wherein $X_1$ and $X_2$ each represents an oxygen atom.

4. A color developer sheet as in claim 1, wherein $X_3$ in general formula (III) represents a hydroxyl group.

5. A color developer sheet as in claim 1, wherein Y represents a sulfur atom or —$CHR_6$.

6. A color developer sheet as in claim 1, wherein Y represents a sulfur atom.

7. A color developer sheet as in claim 1, wherein $R_1$, $R_2$, $R_3$ and $R_4$ each represents an alkyl group or an aryl group, or at least either combination of $R_1$ and $R_2$ and/or $R_3$ and $R_4$ forms a 5- or 6-membered ring together with the carbon atoms to which they are attached respectively.

8. A color developer sheet as in claim 7, wherein both of the combination of $R_1$ and $R_2$ and the combination of $R_3$ and $R_4$ form a 6-membered ring.

9. A color developer sheet as in claim 8, wherein the ring formed is a benzene ring.

10. A color developer sheet as in claim 1, wherein M in formulae (II) and (III) represents a nickel atom, a copper atom or a cobalt atom.

11. A color developer sheet as in claim 10, wherein M represents a nickel atom.

12. A color developer sheet as in claim 1, wherein the organic ligand is an aliphatic, alicyclic, aromatic, aryl-substituted aliphatic or heterocyclic amine.

13. A color developer sheet as in claim 1, wherein the amount of the organic color developer to be coated on a support is within the range of 0.1 $g/m^2$ to 3.0 $g/m^2$.

14. A color developer sheet as in claim 13, wherein the amount of the organic color developer to be coated on a support is within the range of 0.2 $g/m^2$ to 1.0 $g/m^2$.

* * * * *